US008070622B2

(12) United States Patent
Schmidt

(10) Patent No.: US 8,070,622 B2
(45) Date of Patent: Dec. 6, 2011

(54) GOLF PUTTER

(76) Inventor: Jacob H. Schmidt, Rancho Sante Fe, CA (US)

( * ) Notice: Subject to any disclaimer, the term of this patent is extended or adjusted under 35 U.S.C. 154(b) by 0 days.

(21) Appl. No.: 12/157,375

(22) Filed: Jun. 9, 2008

(65) Prior Publication Data

US 2009/0069110 A1 Mar. 12, 2009

Related U.S. Application Data

(60) Provisional application No. 60/970,962, filed on Sep. 9, 2007.

(51) Int. Cl.
*A63B 53/02* (2006.01)

(52) U.S. Cl. ..... 473/313; 473/314; 473/341; 473/350

(58) Field of Classification Search ..... 473/314, 473/340–341, 345, 350, 313
See application file for complete search history.

(56) References Cited

U.S. PATENT DOCUMENTS

| | | | | |
|---|---|---|---|---|
| 2,472,312 | A * | 6/1949 | Parrish | 473/330 |
| 3,749,408 | A * | 7/1973 | Mills | 473/336 |
| 5,211,401 | A * | 5/1993 | Hainey | 473/340 |
| 6,514,153 | B2 * | 2/2003 | Miyamoto et al. | 473/305 |
| D503,445 | S * | 3/2005 | Toroussian | D21/736 |
| 7,435,188 | B2 * | 10/2008 | Tateno et al. | 473/340 |
| 2006/0234810 | A1 * | 10/2006 | Chiodo et al. | 473/340 |

* cited by examiner

*Primary Examiner* — Stephen L. Blau
(74) *Attorney, Agent, or Firm* — Donn K. Harms

(57) ABSTRACT

A golf putter providing a center mount of the hosel to the club head and a shaft engagement to the hosel at the heel end of the club head. The center mount provides the sole engagement of the hosel to the head as a gap is formed by a pathway formed through the body of the head which is larger than the circumference of the hosel in its communication therethrough. The centered engagement provides better touch to the user and feedback on striking a ball while concurrently removing the shaft from the user's line of sight to the ball and club face and reduces the twist or torque at impact with a golf ball, thereby increasing the moment of inertia.

16 Claims, 5 Drawing Sheets

GOLF PUTTER

This application claims the benefit of U.S. Provisional Application 60/970,962 filed Sep. 9, 2007, and which is entirely incorporated herein by reference.

FIELD OF THE INVENTION

The disclosed system and method relate to golf clubs. More particularly it relates to a putter style golf club, having novel central attachment of the distal end of the hosel or club shaft, which engages the head of the putter, solely at a central portion of the club.

BACKGROUND OF THE INVENTION

In the sport of golf, golf clubs are employed to hit a golf ball around the various portions of the course. As a general rule golf clubs fall into three broad categories including woods, irons, and the putter. Woods have club heads formed of wood and/or metal and are designed for striking and propelling the ball long distances down the fairway portion of the golf course. Irons are the clubs employed by golfers for medium distance driving of the ball.

In a conventional set of clubs including such woods and irons, various clubs are designed with a face of the club head to yield differing loft characteristics on ball impact. When the ball is struck generally straight on by the club face, the face angle creates a loft making the golf ball leave the ground on an ascending trajectory. This alleviates the need to swing the club upward to loft the ball.

However, upon placing the ball adjacent to or on the green with a wood or iron, a softer touch is needed by a golfer to sink the ball into the hole. For this purpose, putters are employed to putt the ball into the hole. Unlike woods and irons, putters are employed for a relatively soft contact with the golf ball to roll the ball short distances upon the green surrounding the hole. The putting portion of the game can be especially vexing to golfers since the ball must be accurately driven on the green, taking into consideration the slant of the green and many other variables.

Since during a putt the ball is intended to roll on the grass forming the green rather than to leave it, putters have a very low loft and often a short shaft. The result is a club that is designed to "push" and roll the ball rather than to elevate it upward into the air for long distances. While generally employed for play on the green, putters may on occasion be useful for playing some approach shots on courses with tightly mown fringe and fairways.

There are a number of different styles of putters. Popular head styles include those that are mallet-shaped or blade-shaped; however, many others exist. A mallet putter generally speaking has a large, rounded putter head and is weighted to be balanced throughout the club to provide the user with a more consistent putting stroke. A blade style putter in many popular versions is narrow and flat in order to give the user a tactile sensation or "feel" to the hands when employing the putter.

The head itself may be weighted at the perimeter or have weights adapted for insertion in the head. Perimeter-weighted and toe-weighted putters are considered by many to produce a more forgiving stroke, as the weight is distributed to yield a larger sweet spot on the club face. An insert configured putter head has composite inserts in the head made of a softer material than the rest of the head. The insert is in the face of the putter, sharply defining the sweet spot yielding a smoother roll.

However, most putters of either design have an engagement of the shaft of the club to the hosel engaging the head in a position and attachment mode at the heel end which causes unwanted torque or twisting of the head at the moment of impact with the ball. Additionally, many such shaft and hosel engagements marginalize the feel or tactile sensation of the strike on the ball communicated to the hands of the user gripping the shaft.

Putters with a shaft engaged to a hosel engaging the heel of the head yield a clear view of the ball being struck, but increase the torque on the shaft. This tends to rotate the shaft in the hands of the user even when struck at the head center. Putters having a shaft engaged to a hosel engaging the center portion of the club head, or just a shaft engaging the center of the head, reduce the torque communicated to the shaft upon striking the ball. However, in such an engagement, the shaft can block the view of the ball since it runs through the center of the club. In center mounted heads struck off center, or heel mounted heads even struck on center, the torque generated and resulting twisting tend to rotate the engaged shaft and can easily misdirect the ball along the wrong trajectory from that intended.

Other conventional engagements of the shaft to a hosel engage the distal end of the hosel directly into the head portion of the club either at the heel of the head or into the top central portion of the head. This engagement, while easy to manufacture, engages the hosel at a top or side edge of the head. Thus desired central point of impact of the ball on the head is distanced from the engagement point of the distal end of the hosel thereby dampening the feel of such an impact being transmitted through the club shaft to the user gripping the shaft.

Accordingly, there is an unmet need for a golf putter which provides a shaft engagement or a shaft and hosel engagement to the club head, which provides a means to eliminate or at least minimize the potential for twisting of the shaft upon impact of the center of the face of the head with the ball. Such a putter should provide the uninhibited viewing of the ball that a heel positioning of the shaft and hosel engagement yields, and concurrently produce the minimized torque and resulting shaft twisting provided by a center engagement of the distal end of the hosel or shaft to the head. Still further, such a putter should have a center of gravity that encourages the ball to roll forward rather than loft or backspin by yielding a large sweet spot for impact. Still further, such a shaft to head engagement should also provide increased transmission of the feel of the impact of the head with the ball to allow the user better distance and directional control of their follow-through after impact.

In this respect, before explaining at least one embodiment of the invention in detail, it is to be understood that the invention is not limited in its application to the details of construction and to the arrangement of the components set forth in the following description or illustrated in the drawings nor the steps outlined in the specification. The invention is capable of other embodiments and of being practiced and carried out in various ways as those skilled in the art will readily ascertain from reading and being educated by this application. Also, it is to be understood that the phraseology and terminology employed herein are for the purpose of description and should not be regarded as limiting.

As such, those skilled in the art will appreciate that the conception upon which this disclosure is based may readily be utilized as a basis for designing other methods and systems for carrying out the several purposes of the present invention of a golf putter having a center engaged hosel extending from the center of gravity of the head to the shaft. It is important, therefore, that the claims be regarded as including such equivalent construction insofar as they do not depart from the spirit and scope of the present invention.

SUMMARY OF THE INVENTION

The disclosed device and method of employment thereof, provides a novel improvement in the field of golf putters. As can be seen in FIGS. 1-11, in a preferred mode of the device, the device employs a hosel with a socket or recessed perimeter on a first end adapted to be engaged on the distal end of a golf shaft which is gripped by a user. Between the socket and a distal or opposite end of the hosel, the hosel member has an external circumference sized to be smaller than a passage communicating through the top or side surface of the head of the club with a cavity formed in the head behind the face.

Means for separated transition of the hosel through the heel portion of the club may be provided by the aperture which is formed at a position adjacent to the heal end of the putter head and communicates untouched through a passage to the central portion of the head. A slot or cut out might also provide the relief area adjacent to the heel to eliminate contact of the hosel with the head at this point. As noted below, a golf shaft if bent properly could substitute for the hosel and is anticipated; however, the hosel is preferred due to balance and manufacturing concerns.

The passage so formed being larger than the member forming a central portion of the hosel or shaft thereby provides a gap between the member portion of the hosel and the putter head, and only the distal end of the hosel is connected to the head at a central portion of the head. At the side surface of the head where the gap communicates with the passage the gap may be left empty or may be filled with an o-ring or other flexible material depending on the individual user's preference.

At a central portion of the hosel between the engagement with the shaft and the engagement with the head, the hosel member may angle upwardly to provide a vertical projection adjacent to the heel portion of the head. This allows for attachment of the shaft at the first end of the hosel. This projection of the first end above the top surface at the heel provides for a center attachment of the hosel to the club, without obstructing the view of the ball in front of the face. The angle depicted in the drawings is at substantially 45 degrees which is one preferred mode of the device; however, the angle can vary depending on the exit point of the first end of the hosel from the passage adjacent to the heel end of the head.

At the distal end of the hosel opposite the first end the hosel member may be dimensioned substantially similar to a notch formed in a center post defined by opposing cavities in the club head. This similar configuration allows for engagement to the center post. The width of the center post is defined by producing cavities on either side of the center post in the rear of the head opposite the face.

Weight of the club head at the heel and toe ends can also be varied to maximize reduction of torque communication to the shaft during the moment of impact with a golf ball.

Other aspects and features of the present invention will be noted upon examination of the drawings, description of the best and various modes for carrying out the invention, and claims, all of which constitute disclosure of the present invention.

It is an object of this invention to provide a putter which minimizes twisting of the shaft on impact of the head with the golf ball in a putting stroke, by engagement of the shaft-engaged hosel solely to a central portion of the club head.

It is a further object of this invention to provide the unobstructed view of the ball yielded by an engagement of the shaft with the hosel adjacent to the heel of the club, while concurrently providing the benefits of stability from an engagement of the hosel to the center of the head.

It is a further object to provide a putter having such a novel attachment of the hosel to the head which provides a center of gravity at a contact point of the ball on the face of the club head to encourage rolling of the ball.

It is a further object to minimize unwanted twisting of the shaft during accelerations and decelerations of the head during the stroke of the putter, through such a central attachment of the hosel to the head, to thereby minimize rotational forces during the stroke of the club head to bring the face of the club head to an even contact with the golf ball at impact.

It is a further object to employ one of a gap at a transition passage of the hosel through a heel portion of the head, to thereby maximize and better transmit the feeling of the impact of the face of the head with the ball up the shaft to the user's hands for better distance and directional control of the ball toward the targeted hole.

It is yet another object of this invention to provide a club with quicker feedback to the hands of the user of the impact with the ball to maximize the user's distance and directional control of the ball.

It is a further object of this invention to allow for employment of a flexible ring at the transition of the hosel through the head proximate to the heel, to thereby impart a padded contact of the hosel with the club head to thereby absorb a portion of the energy during the putting stroke and which will redirect the energy to the golf ball so as to provide better feel and smoother roll.

It is a further object of this invention to provide a putter with a center attached hosel that will eliminate or reduce the amount of initial skidding or back spinning of the golf ball after leaving the face of the putter at impact through smoother contact, to thereby provide a smoother transition of the golf ball from its stationary position to its final free roll.

These together with other objects and advantages which will become subsequently apparent reside in the details of the construction and operation as more fully hereinafter described and claimed, reference being had to the accompanying drawings forming a part thereof, wherein like numerals refer to like parts throughout.

DETAILED DESCRIPTION OF THE PREFERRED EMBODIMENTS

Figure 1:
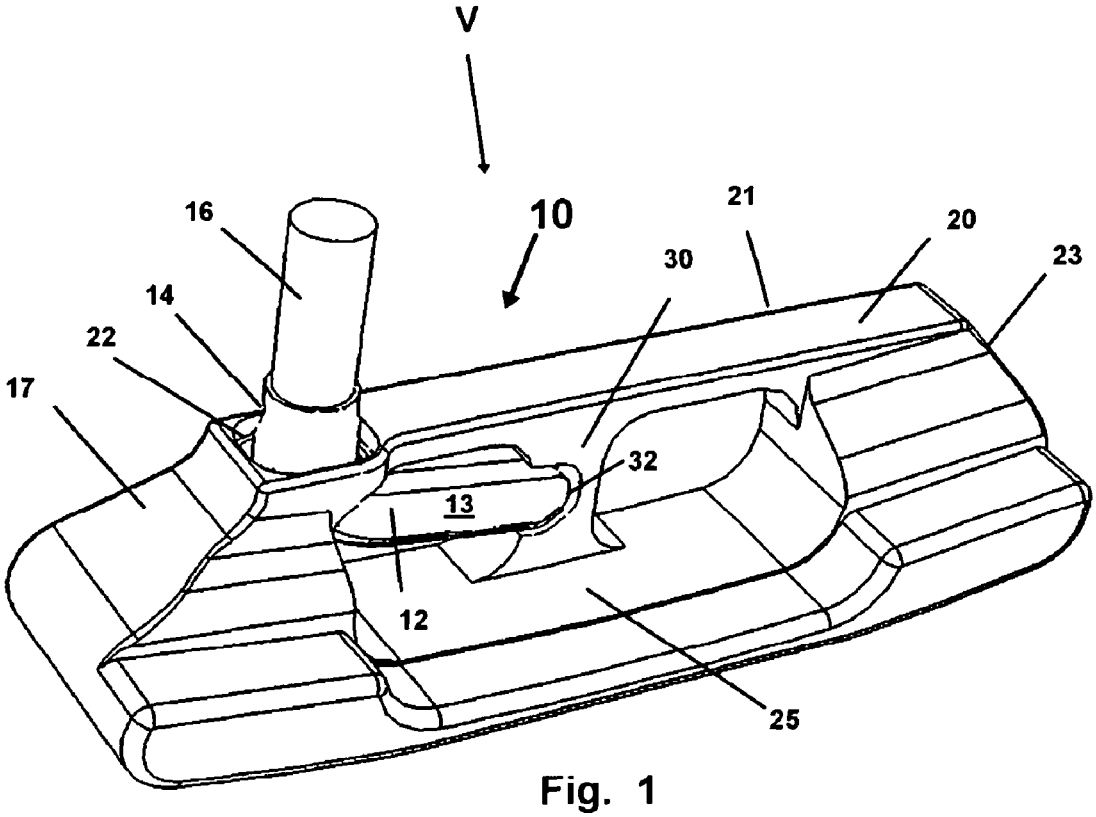
FIG. 1 depicts an overhead perspective view of a preferred mode of the device showing the engagement of the hosel solely to a center portion of the head.
Figure 2:
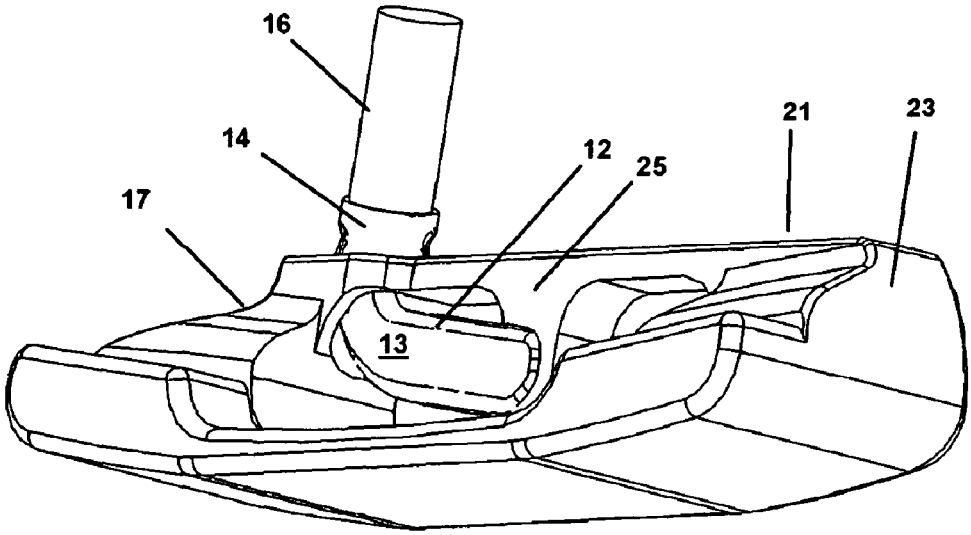
FIG. 2 is perspective view of the putter of FIG. 1 from a position below the head showing the communication of the hosel through a passage in the heel side of the head.
Figure 3:
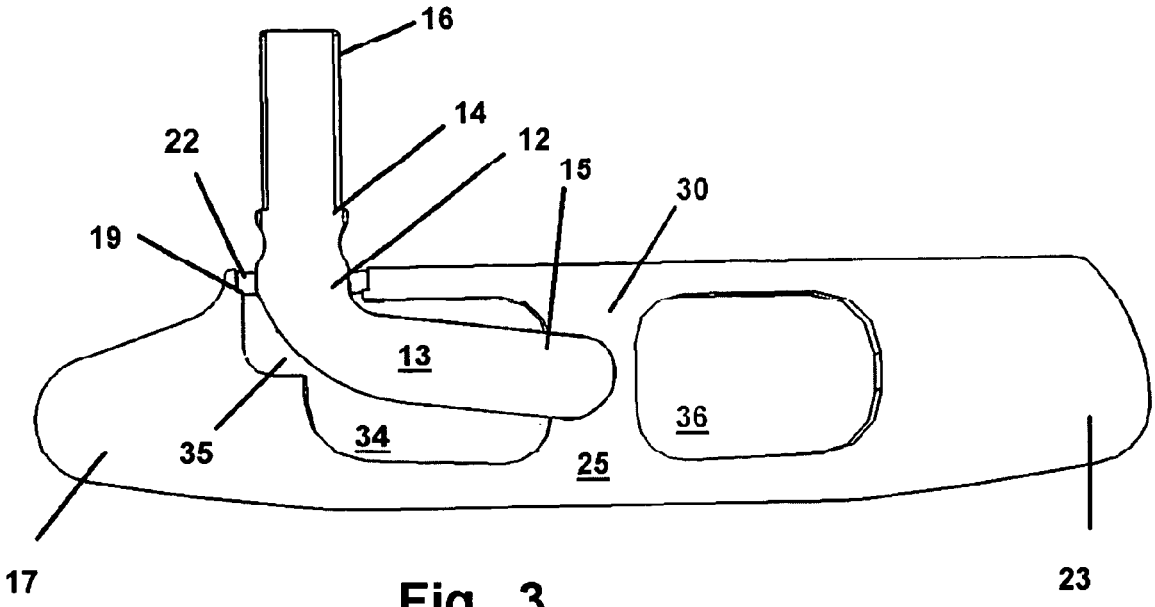
FIG. 3 depicts a sliced view of the device showing the gap or passage surrounding the hosel from the head and connection to a center portion of the head solely at a distal end of the hosel. The angle depicted of the hosel may be varied.
Figure 4:
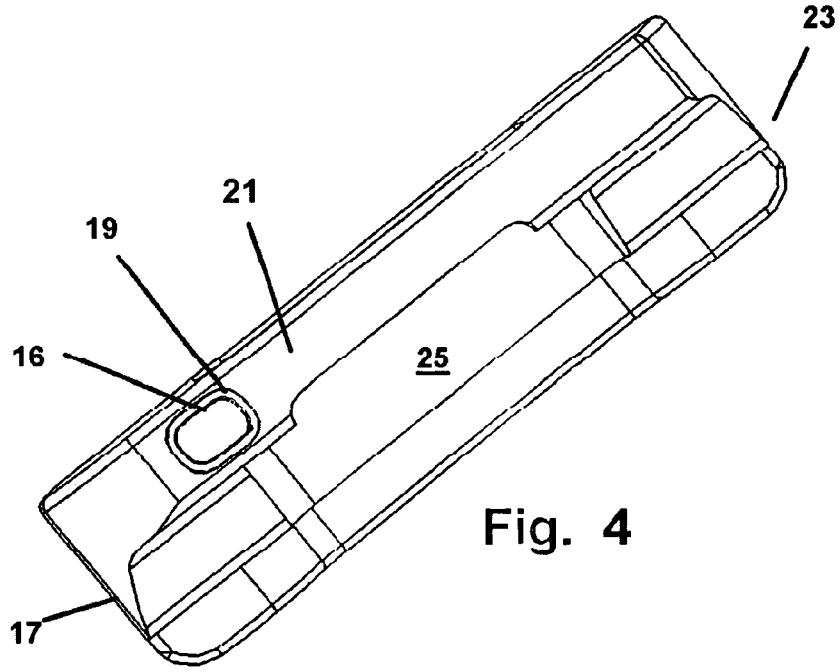
FIG. 4 depicts an overhead view of the club head showing a passage adjacent to the heel portion of the head sized larger than the circumference of the hosel communicating therethrough and the optional playable ring.
Figure 5:
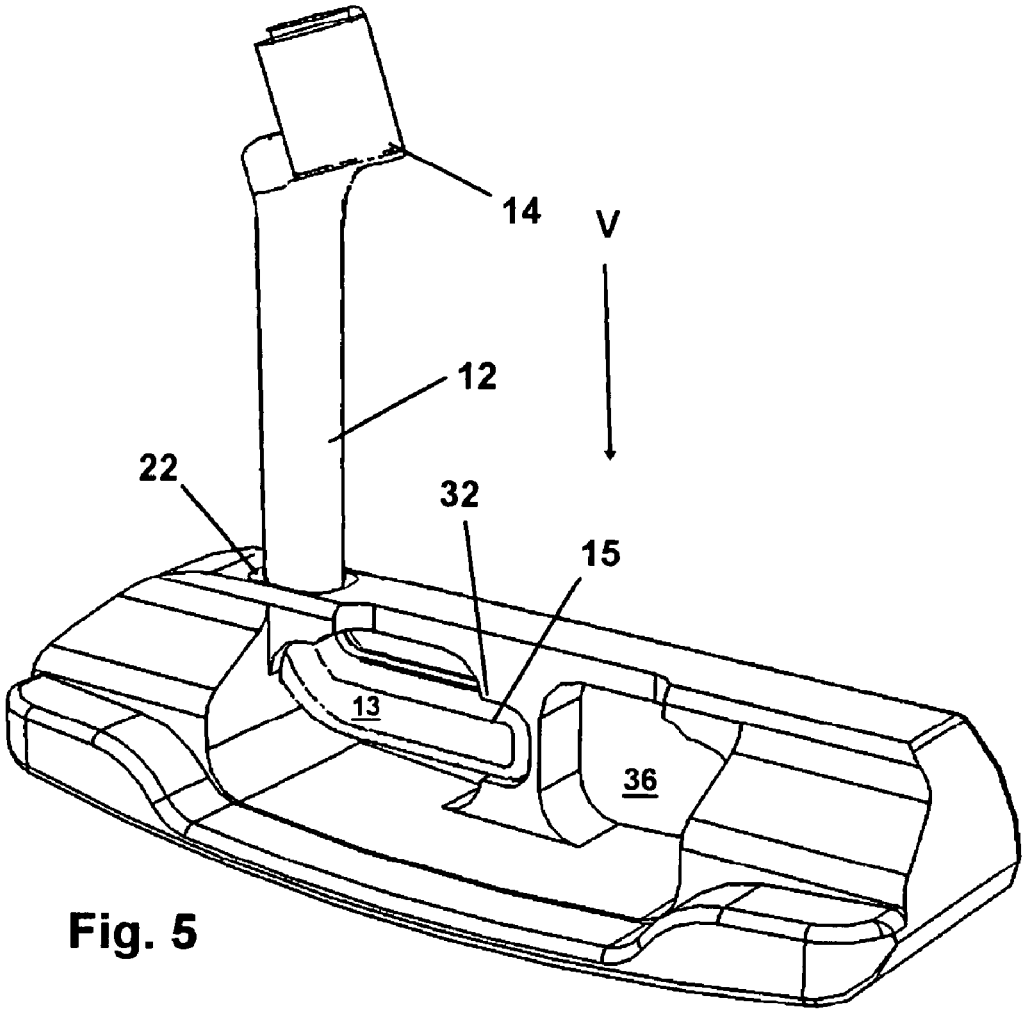
FIG. 5 depicts a perspective view of another mode of the device with a first end of the hosel extending upward to an angled engagement for a club shaft.
Figure 6:
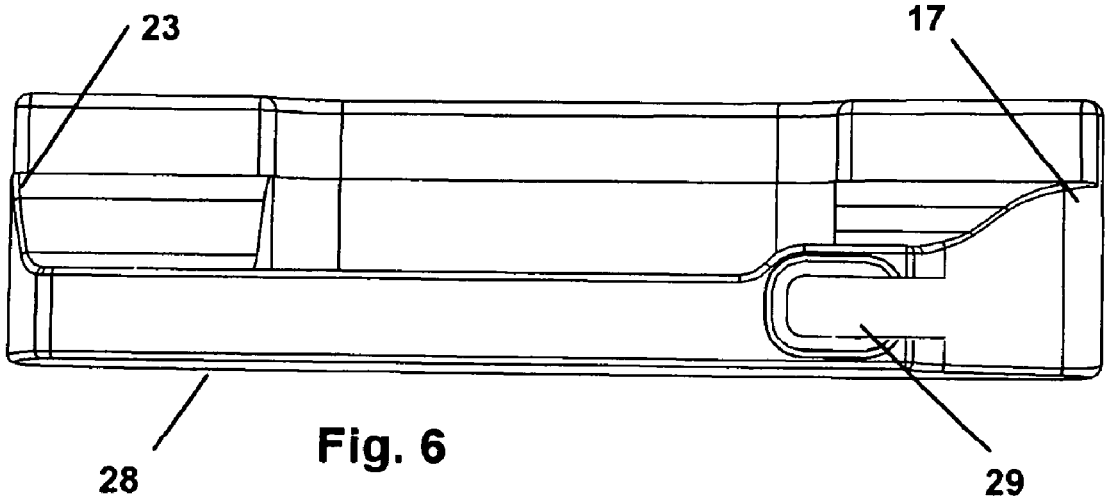
FIG. 6 depicts a slotted communication of the heel of the head with the passage therethrough allowing engagement of the hosel solely with a center portion of the head.

Referring now to all of the drawings in FIGS. 1-11, wherein similar parts are identified by like reference numerals, the device 10 is depicted in FIG. 1 which shows a perspective view. As can be seen in FIGS. 1-3 in a mode of the device 10 employing a hosel 12 to shaft 16 engagement of the head 21, the hosel 12 has a collar 14 at a first end which is adapted to be engaged on a golf club shaft 16 in which the club is gripped by a user. Or, alternatively as shown in FIG. 3, the hosel 12 may have an outside diameter at its first end adapted for insertion inside the axial passage at the distal end of the shaft 16.

As shown in FIGS. 1-2 3, and 5, the hosel 12 has member 13 communicating from the first end, to a distal end 15 which has a circumference sized smaller than the passageway communicating through the heel 17 end of the head 21 to the center portion where the distal end 15 connects with the head 21.

The passage in one favored mode is provided by an aperture 18 formed in the top surface 20 or side surface of the putter head 21 at a position adjacent to the heal 17 of the putter head 21. A spaced communication through the aperture 18 of the hosel 12 exterior is provided by circumference of the aperture 18 which thereby provides a gap between the hosel 12 and the body of the putter head 21. Depending on the user this gap 22 may be left open, or may be filled by an O-ring 19 at the point the hosel 12 communicates through the aperture 18. The employment of the aperture 18 makes the feel of the device 10 highly customizable for the user. Leaving the O-ring out of the aperture 18 allows the force of the ball striking the head to generate an immediate feel to the user's hands for better distance and directional control from the quicker feedback. If an o-ring is employed, it slightly dampens the feel imparted to the shaft and it may be varied in hardness to thereby provide means to vary the vibration or impact of the ball on the face transmitted to the shaft 16. Inserting and varying the hardness of the o-ring thus provides a means to vary the rebound of the club head 21 after striking a ball along with varying the feel transmitted to the user up the shaft 16 on striking the ball.

As shown in FIGS. 1-3, at a central portion of the hosel 12 between the first end and the distal end 15, the member 13 angles toward the top 20 of the head at the heel end 17 of the putter head 21 thereby providing a substantially vertical or perpendicular projection of the first end of the hosel 12 above the top surface 20 of the head 21 adjacent to the heel 17. This allows for an engagement of the shaft 16 to the collar 14 at the heel 17 end, while concurrently providing an engagement of the hosel 12 to the head 21 solely at the central portion 25 of the head 21. Putters have an in-use position wherein said shaft is engaged in the hands of a user in a conventional grip of the putter for striking ball with the face of said head, with the user positioned over the face. In the in-use position, the benefits of stability on striking the ball from the central engagement of the hosel 12 to the head 21 are provided.

Additionally, during such use, the heel-side positioning of the shaft 16, opposite the toe 23 being thus provided, eliminates the problem encountered with current center engaged shafts on putters which position the shaft 16 in front of the ball and face contact. This is because the shaft 16 which would normally be in the way of the user looking down at the ball from above along view line "V", and targeting the face 28 to hit the ball at the center of the head, is instead positioned adjacent to the heel 17, and can further be angled if necessary to eliminate this obstruction of the view of a ball when held by the user during a putt.

Figure 7:
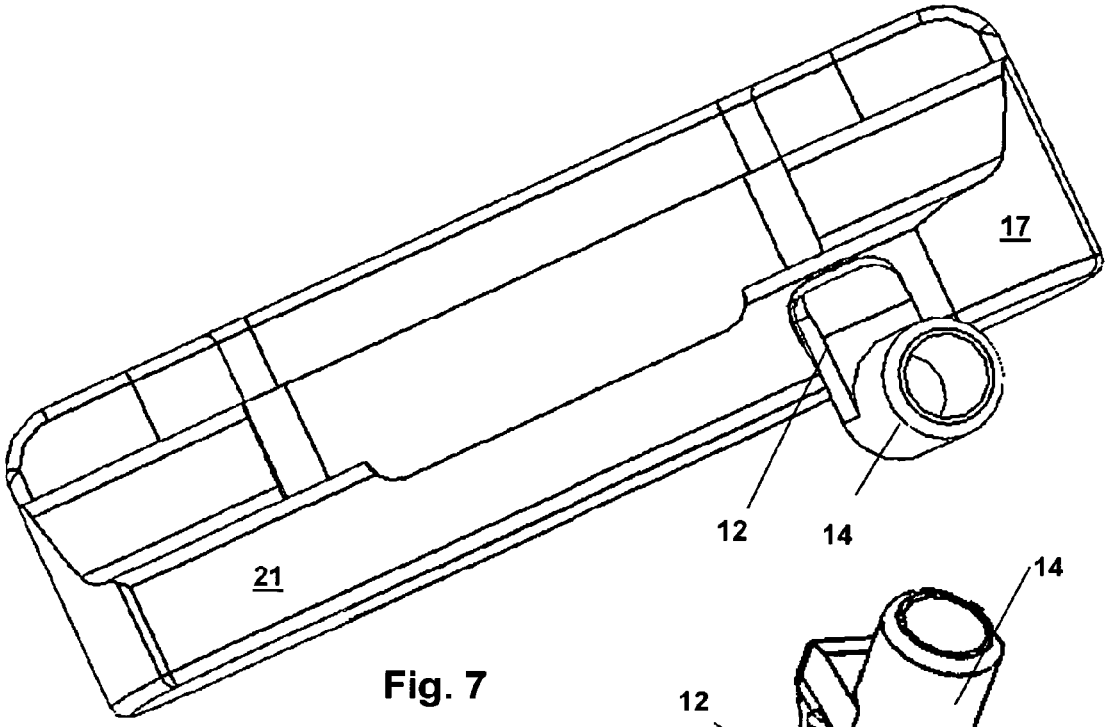
FIG. 7 depicts an overhead perspective view of the device as shown in FIG. 5 and showing the first end of the hosel adapted to engage a golf club shaft.
Figure 8:
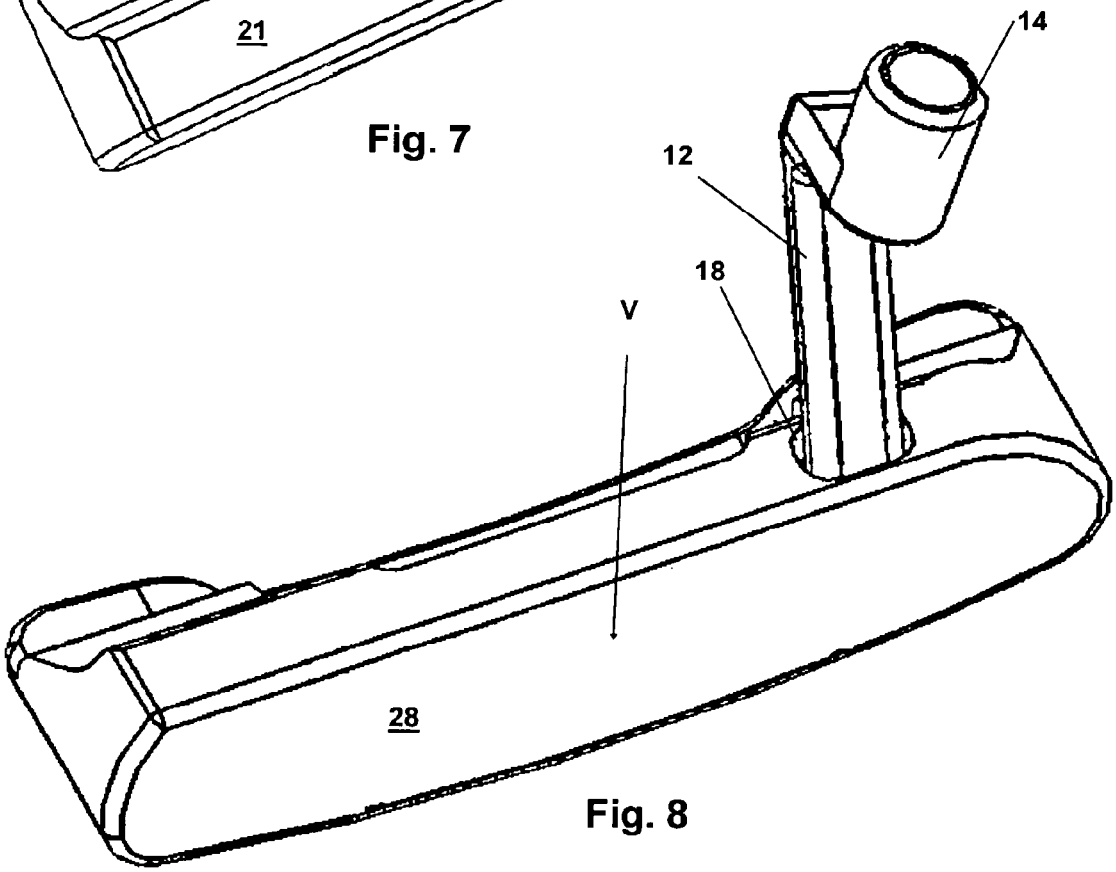
FIG. 8 depicts the face of the head and shows the gap between the hosel and the head.

The angle of engagement of the collar 14 to the hosel 12 may be varied according to user preference with the angle shown at FIG. 1 being less than 45 degrees and that shown in FIGS. 7-8 being substantially 45 degrees which is one preferred mode of the device 10 at present. However those skilled in the art will realize that other angles may be employed to yield the attachment at the center post 30 or other engagement point in the central portion 25 of the head 21 depending on user height, and eliminating obstruction of ball view by the shaft 16. In any such attachment the aperture 18 and cavity surrounding the hosel 12 must be sufficiently large so as to not contact the hosel with the head 21 except for the engagement to the central portion 25.

As can be seen in FIG. 7, in one mode of the device 10, to show the adjustment of balance achievable by different shaped hosels 12, the collar 14 on the hosel 12 is positioned at the first end of the hosel 12 in a manner to engage with the member 13 portion of the hosel 12 at a position forward of the face 28 of the putter head. An opposite or distal end 15 of the member 13 of the hosel 12 engages the head 21 solely at the attachment point in the central portion 25 of the head 21. As depicted this engagement point is formed by a center post 30 having a notch 32 in a center post 30 which is positioned between two cavities 34 and 36 (FIG. 3) formed in the putter head 21.

The distal end 15 of the hosel 12 is substantially the sole connection point to the head 21 and is affixed to the similarly dimensioned notch 32 in the center post 30 using means of attachment such as adhesive or welding or other means for permanent engagement. If disassembly for customization is desired, a set screw (not shown) may also be employed as a means for attachment. This arrangement allows for any number of hosels 12 to be engaged to the center post 30 so long as their distal ends match the engagement notch 32 thereby rendering the device highly customizable to user requirements on manufacture. A slight bit of flex in this engagement in one preferred mode of the device 10 is provided by either flex of the member 13 or the means of engagement.

The amount of heel and toe weight at the ends of the club head 21 on either side of the central portion 25 can also be varied in the device 10. This allows for increased reduction of the amount of torque or achieving zero torque or twisting of the shaft at impact with a properly struck golf ball. Varying the heel and toe weight relative to each other is accomplished by shaving the shape of the club head 21, or increasing and decreasing the size of the cavities 34 and 36, or adding weights to the rear or top portion. The weights (not shown) may be formed to fit into the cavities 34 and 36 and may be engaged removably so they may be varied to user preference. Additionally the club heads 21 may be varied in dimension so long as they are adapted to engage the hosel 12 which allows for heel or toe weighted heads 21, mallets, straight blades, half mallets, and virtually any dimensioned head 21 that is adapted to solely engage the hosel 12 at a middle section and with an aperture 18 and surrounding gap separating the rest of the hosel 12 from the head 21.

The passage providing the gap surrounding the hosel 12 through the head 21 may also be provided by means other than the aperture 18 communicating with the passage 35 formed by a slot 29 communicating with the cavity 34 as shown in FIG. 3. Other means to provide a passageway providing the continuous gap between the hosel 12 and the head 21 to thereby provide engagement of the hosel 12 solely to a central portion 25 of the head 21 will no doubt occur to those skilled in the art once educated by this disclosure to the benefits of such. All such engagements providing a connection of the distal end 15 of the hosel 12 to a central portion 25 of the head 21 which position the shaft 16 adjacent to the heel 17 end of the head 21 or in other positions are anticipated within the scope of this invention.

In a method of forming a putter device 10 as herein disclosed, a putter head 21 would be formed and a passage formed therein sized to allow communication of a hosel 12 from a position adjacent to the heel 17 with a central portion 25 of the head 21 where the passage is larger than the circumference of the hosel 12. A first end of the hosel 12 communicating from the passage adjacent to the heel 17 would be engaged to a golf club shaft 16 subsequent to the engagement of the distal end 15 opposite the first end, to an engagement point at a central portion 25 of the head 21. In this manner, a golf putter is formed which provides connection of the hosel 12 solely at the central portion 25 of the head 21, but, positions the shaft 16 engaging the hosel 12 adjacent to the heel 17 of the head 21 out of the line of sight of the user to the ball and face 28 of the head 21.

While the employment of a hosel 12 as noted above allows a maximizing of customization of the weighting and positioning of the head 21 relative to the descending shaft 16, those skilled in the art will realize that a properly bent and reinforced shaft 16 might also be employed without the hosel 12. While not offering as much utility, such a configuration would still yield the benefits of the impact transmission through the club shaft 16 noted above if solely connected a the central portion 25 of the head 21.

Figure 9:
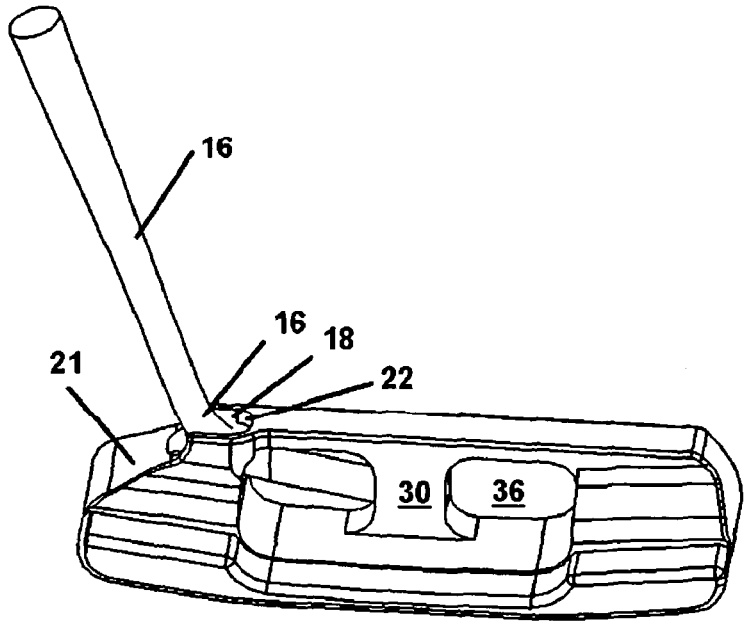
FIG. 9 shows a mode of the device where the club shaft has been formed at a distal end to pass through the passage and engage the club head without a hosel.

FIG. 9 shows a mode of the device 10 where the club shaft 16 has been formed at a distal end to pass through the aperture 18 into the passage 35 (FIG. 3) thereby defining a passageway that has a gap between the club head 21 and shaft 16. In the same manner as the mode of the device 10 employing a hosel 12, the shaft 16 does not contact the club head 21 but for the connection at the central portion. An O-ring 19 may be employed to fill the gap in the aperture 18 optionally if the user desires.

Figure 10:
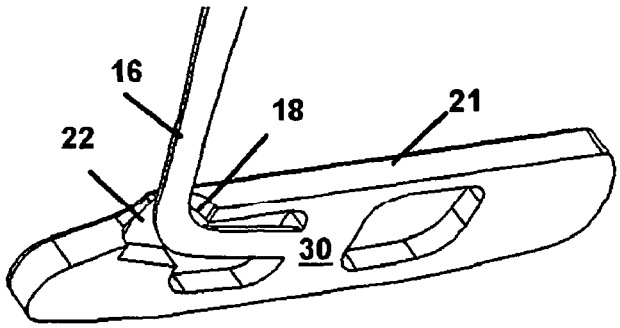
FIG. 10 depicts a perspective sliced view of the head showing the gap and passage separating the incoming club (or hosel if employed) from contact with the head.

FIG. 10 depicts a perspective sliced view of the head 21 showing the gap 22 between the shaft 16 and the head 21 which extends the full length of the communication of the shaft 16 into the head 21 to the attachment point.

Figure 11:
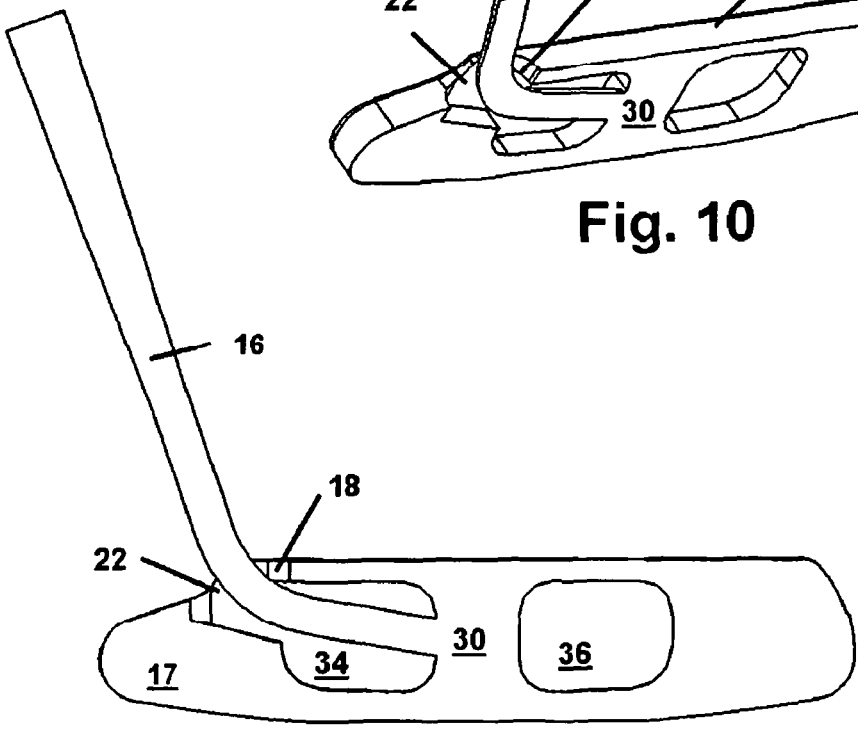
FIG. 11 depicts a club shaft having a bent portion adapted to communicate through the passage in the club head to a mount with the central portion of the head.

FIG. 11 depicts a side view of FIG. 10 showing the club shaft 16 having a bent portion at the distal end which is adapted to communicate through the passage 34 in the club head 21 to the attachment point solely at the central portion 25 of the head 21. In the modes of the device 10 shown in FIGS. 9-11, the distal end shaft 16 is dimensioned to communicate through the passage as noted and as with the hosel 12, the sole connection point to the head 21 is by engagement to the center post 30 using means of attachment such as adhesive or welding or other means for permanent engagement.

While all of the fundamental characteristics and features of the golf putter with center engaged hosel and heel positioned shaft herein have been disclosed and described, with reference to particular embodiments thereof, a latitude of modifications, various changes and substitutions are intended in the foregoing disclosure and it will be apparent that in some instance, some features of the invention will be employed without a corresponding use of other features without departing from the scope of the invention as set forth. It should be understood that such substitutions, modifications, and variations may be made by those skilled in the art, without departing from the spirit or scope of the invention herein disclosed. Consequently, all such modifications and variations as would occur to those skilled in the art, are included within the scope of the invention as defined herein.

What is claimed is:

1. A golf putter comprising:

a head formed of a body, said body having a heel end and a toe end and a central portion therebetween;

said body having a face adapted for contact with a golf ball;

a first cavity formed in said central portion of said body adjacent to said toe;

a second cavity formed in said central portion of said body adjacent to said heel; and a rib separating said first cavity and said second cavity;

a hosel having a first end adapted for engagement to a shaft and having a distal end opposite said first end and having a middle section there between;

a pathway communicating through said body from a point adjacent to said heel end to said central portion;

said hosel communicating through said pathway to an attachment point on said rib;

means for engagement of said distal end of said hosel with said attachment point; and said pathway dimensioned larger than said hosel communicating therethrough thereby defining a gap between said pathway surrounding said hosel between said point adjacent to said heel and said attachment point.

2. The golf putter of claim 1, additionally comprising:

said putter having an in-use position wherein said shaft is engaged in the hands of a user for striking said ball with said face of said head; and said shaft engaged to said rib by said hosel, thereby providing means to position said shaft out of the user's view of a ball striking said face.

3. The golf putter of claim 2, additionally comprising:

said attachment point being substantially centered between said heel and said toe.

4. The golf putter of claim 3 additionally comprising:

said second cavity extending into a notch in said rib;

said distal end of said hosel dimensioned substantially similar to a shape of said notch; and adhesive or welding providing a means of permanent engagement of said distal end within said notch.

5. The golf putter of claim 4 additionally comprising:

said rib being centered between said heel and said toe.

6. The golf putter of claim 5 additionally comprising:

a pliable ring positioned to fill said gap at said point adjacent to said heel; and said ring engaging both said hosel and said pathway.

7. The golf putter of claim 2 additionally comprising:

said second cavity extending into a notch in said rib;

said distal end of said hosel dimensioned substantially similar to a shape of said notch; and adhesive or welding providing a means of permanent engagement of said distal end within said notch.

8. The golf putter of claim 7 additionally comprising:
said rib being centered between said heel and said toe.

9. The golf putter of claim 1, additionally comprising:
said attachment point being substantially centered between said heel and said toe.

10. The golf putter of claim 9 additionally comprising:
said second cavity extending into a notch in said rib;
said distal end of said hosel dimensioned substantially similar to a shape of said notch; and
adhesive or welding providing a means of permanent engagement of said distal end within said notch.

11. The golf putter of claim 10 additionally comprising:
said rib being centered between said heel and said toe.

12. The golf putter of claim 1 additionally comprising:
said second cavity extending into a notch in said rib;
said distal end of said hosel dimensioned substantially similar to a shape of said notch;
adhesive or welding providing a means of permanent engagement of said distal end within said notch.

13. The golf putter of claim 12 additionally comprising:
said rib being centered between said heel and said toe.

14. The golf putter of claim 1 additionally comprising:
a pliable ring positioned to fill said gap at said point adjacent to said heel; and
said ring engaging both said hosel and said pathway.

15. A method of manufacture of a golf putter having a shaft engaged to a hosel which is engaged to a head formed of a body having a heel end and a toe end, and having a face adapted to strike a golf ball communicating along a central portion positioned between said head end and said heel end, comprising the steps of:
forming a passage communicating from a position adjacent to said heel to a central portion of said body between said toe end and said heel end, with a diameter of said passage being larger than an exterior circumference of said hosel;
engaging a distal end of a hosel having a first end opposite thereto, with said central portion by insertion through said passage thereby forming a gap between passage and said and said exterior circumference of said hosel;
engaging said shaft to said first end to extend away from said head at an angle positioning said shaft out of a view of a user holding said shaft while striking said golf ball with said face, whereby said user is able to employ said putter having a centrally engaged hosel and a view of the ball and face unobstructed by said shaft.

16. A golf putter comprising:
a head formed of a body, said body having a heel end and a toe end and a central portion therebetween;
said body having a face adapted for contact with a golf ball;
a cavity located in said central portion;
a rib dividing said cavity;
a pathway communicating through said body from a point adjacent to said heel end to said central portion;
a shaft having a first end for gripping by a user and a distal end opposite said first end;
said distal end of said shaft dimensioned for communicating through said pathway to an attachment point on said rib;
means for engagement of said distal end of said shaft with said attachment point; and
said pathway dimensioned larger than said distal end of said shaft communicating therethrough thereby defining a gap between said pathway surrounding said shaft between said point adjacent to said heel and said attachment point.

* * * * *